US010029304B2

(12) United States Patent
Schramm et al.

(10) Patent No.: US 10,029,304 B2
(45) Date of Patent: Jul. 24, 2018

(54) RAPID DISCHARGE HEATING AND FORMING OF METALLIC GLASSES USING SEPARATE HEATING AND FORMING FEEDSTOCK CHAMBERS

(71) Applicant: Glassimetal Technology, Inc., Pasadena, CA (US)

(72) Inventors: Joseph P. Schramm, Sierra Madre, CA (US); Marios D. Demetriou, West Hollywood, CA (US); William L. Johnson, San Marino, CA (US)

(73) Assignees: Glassimetal Technology, Inc., Pasadena, CA (US); Apple Inc., Cupertino, CA (US)

( * ) Notice: Subject to any disclaimer, the term of this patent is extended or adjusted under 35 U.S.C. 154(b) by 303 days.

(21) Appl. No.: 14/743,560

(22) Filed: Jun. 18, 2015

(65) Prior Publication Data

US 2015/0367410 A1 Dec. 24, 2015

Related U.S. Application Data

(60) Provisional application No. 62/013,671, filed on Jun. 18, 2014.

(51) Int. Cl.

| | |
|---|---|
| ***C22C 45/00*** | (2006.01) |
| ***B22D 17/20*** | (2006.01) |
| ***B22D 25/06*** | (2006.01) |

(52) U.S. Cl.

CPC ..... *B22D 17/2038* (2013.01); *B22D 25/06* (2013.01); *C22C 45/00* (2013.01)

(58) Field of Classification Search

None

See application file for complete search history.

(56) References Cited

U.S. PATENT DOCUMENTS 2,467,782 A 12/1947 Schuman
2,816,034 A 12/1957 Mittelmann
(Continued)

FOREIGN PATENT DOCUMENTS

CN 1552940 12/2004
CN 1689733 11/2005
(Continued)

OTHER PUBLICATIONS

De Oliveira et al., "Electromechanical engraving and writing on bulk metallic glasses", Applied Physics Letters, Aug. 26, 2002, vol. 81, No. 9, pp. 1606-1608.

(Continued)

*Primary Examiner* — George P Wyszomierski
(74) *Attorney, Agent, or Firm* — Polsinelli PC

(57) ABSTRACT

The present disclosure is directed to a method of physically separating and electrically isolating the chamber where the ohmic heating of the feedstock occurs by delivering current through the electrodes (heating barrel), from the chamber where the feedstock deformation and flow through the runner takes place by the motion of the plungers (forming barrel). The method also includes transferring the feedstock from the heating barrel to the forming barrel between the heating and the forming processes at a high enough rate such that negligible cooling and no substantial crystallization of the feedstock occurs during the transfer.

18 Claims, 5 Drawing Sheets

(56) References Cited

U.S. PATENT DOCUMENTS

| | | | |
|---|---|---|---|
| 3,332,747 | A | 7/1967 | Bundy |
| 3,537,045 | A | 10/1970 | Ichiro |
| 3,863,700 | A | 2/1975 | Bedell et al. |
| 4,115,682 | A | 9/1978 | Kavesh et al. |
| 4,355,221 | A | 10/1982 | Lin |
| 4,462,092 | A | 7/1984 | Kawabuchi et al. |
| 4,523,748 | A | 6/1985 | Latter |
| 4,715,906 | A | 12/1987 | Taub et al. |
| 4,809,411 | A | 3/1989 | Lin et al. |
| 4,950,337 | A | 8/1990 | Li et al. |
| 5,005,456 | A | 4/1991 | Ballard et al. |
| 5,069,428 | A | 12/1991 | Li et al. |
| 5,075,051 | A | 12/1991 | Ito et al. |
| 5,278,377 | A | 1/1994 | Tsai |
| 5,288,344 | A | 2/1994 | Peker et al. |
| 5,324,368 | A | 6/1994 | Masumoto et al. |
| 5,368,659 | A | 11/1994 | Peker et al. |
| 5,550,857 | A | 8/1996 | Richards |
| 5,554,838 | A | 9/1996 | Berdich |
| 5,618,359 | A | 4/1997 | Lin et al. |
| 5,735,975 | A | 4/1998 | Lin et al. |
| 5,896,642 | A | 4/1999 | Peker et al. |
| 6,027,586 | A | 2/2000 | Masumoto et al. |
| 6,235,381 | B1 | 5/2001 | Sanders et al. |
| 6,258,183 | B1 | 7/2001 | Onuki et al. |
| 6,279,346 | B1 | 8/2001 | Ribes et al. |
| 6,293,155 | B1 | 9/2001 | Babiel |
| 6,355,361 | B1 | 3/2002 | Ueno et al. |
| 6,432,350 | B1 | 9/2002 | Seres et al. |
| 6,771,490 | B2 | 8/2004 | Peker et al. |
| 6,875,293 | B2 | 4/2005 | Peker |
| 7,120,185 | B1 | 10/2006 | Richards |
| 7,506,566 | B2 | 3/2009 | Decristofaro et al. |
| 7,883,592 | B2 | 2/2011 | Hofmann et al. |
| 8,099,982 | B2 | 1/2012 | Takagi et al. |
| 8,276,426 | B2 | 10/2012 | Musat et al. |
| 8,499,598 | B2 | 8/2013 | Johnson et al. |
| 8,613,813 | B2 | 12/2013 | Johnson et al. |
| 8,613,814 | B2 | 12/2013 | Kaltenboeck et al. |
| 8,613,815 | B2 | 12/2013 | Johnson et al. |
| 8,613,816 | B2 | 12/2013 | Kaltenboeck et al. |
| 8,776,566 | B2 | 7/2014 | Johnson et al. |
| 9,044,800 | B2 | 6/2015 | Johnson et al. |
| 2001/0033304 | A1 | 10/2001 | Ishinaga et al. |
| 2003/0056562 | A1 | 3/2003 | Kamano |
| 2003/0183310 | A1 | 10/2003 | McRae |
| 2003/0222122 | A1 | 12/2003 | Johnson et al. |
| 2004/0035502 | A1 | 2/2004 | Kang et al. |
| 2004/0067369 | A1 | 4/2004 | Ott et al. |
| 2005/0034787 | A1 | 2/2005 | Song et al. |
| 2005/0103271 | A1 | 5/2005 | Watanabe et al. |
| 2005/0202656 | A1 | 9/2005 | Ito et al. |
| 2005/0217333 | A1 | 10/2005 | Daehn |
| 2005/0236071 | A1 | 10/2005 | Koshiba et al. |
| 2006/0102315 | A1 | 5/2006 | Lee et al. |
| 2006/0293162 | A1 | 12/2006 | Ellison |
| 2007/0003782 | A1 | 1/2007 | Collier |
| 2007/0023401 | A1 | 2/2007 | Tsukamoto et al. |
| 2007/0034304 | A1 | 2/2007 | Inoue et al. |
| 2008/0081213 | A1 | 4/2008 | Ito et al. |
| 2008/0135138 | A1 | 6/2008 | Duan et al. |
| 2008/0302775 | A1 | 12/2008 | Machrowicz |
| 2009/0236017 | A1 | 9/2009 | Johnson et al. |
| 2009/0246070 | A1* | 10/2009 | Tokuda ..... C22C 1/002 420/407 |
| 2010/0009212 | A1 | 1/2010 | Utsunomiya et al. |
| 2010/0047376 | A1 | 2/2010 | Imbeau et al. |
| 2010/0121471 | A1 | 5/2010 | Higo et al. |
| 2010/0320195 | A1 | 12/2010 | Fujita et al. |
| 2011/0048587 | A1 | 3/2011 | Vecchio et al. |
| 2012/0103478 | A1 | 5/2012 | Johnson et al. |
| 2013/0025814 | A1 | 1/2013 | Demetriou et al. |
| 2013/0048152 | A1 | 2/2013 | Na et al. |
| 2013/0319062 | A1 | 12/2013 | Johnson et al. |
| 2014/0033787 | A1 | 2/2014 | Johnson et al. |
| 2014/0047888 | A1 | 2/2014 | Johnson et al. |
| 2014/0083150 | A1 | 3/2014 | Kaltenboeck et al. |
| 2014/0102163 | A1 | 4/2014 | Kaltenboeck et al. |
| 2014/0130563 | A1 | 5/2014 | Lee et al. |
| 2014/0283956 | A1 | 9/2014 | Schramm et al. |
| 2015/0090375 | A1 | 4/2015 | Lee et al. |
| 2015/0096967 | A1 | 4/2015 | Lee et al. |
| 2015/0231675 | A1 | 8/2015 | Johnson et al. |
| 2015/0299825 | A1 | 10/2015 | Prest et al. |
| 2016/0298205 | A1 | 10/2016 | Johnson et al. |

FOREIGN PATENT DOCUMENTS

| | | |
|---|---|---|
| CN | 201838352 | 5/2011 |
| CN | 103320783 | 9/2013 |
| FR | 2806019 | 9/2001 |
| GB | 215522 | 5/1924 |
| GB | 2148751 | 6/1985 |
| JP | 48-008694 | 3/1973 |
| JP | 63-220950 | 9/1988 |
| JP | H06-57309 | 3/1994 |
| JP | H06-277820 | 10/1994 |
| JP | H 08-024969 | 1/1996 |
| JP | 08-300126 | 11/1996 |
| JP | 10-263739 | 10/1998 |
| JP | 10-296424 | 11/1998 |
| JP | 11-001729 | 1/1999 |
| JP | 11-104810 | 4/1999 |
| JP | 11-123520 | 11/1999 |
| JP | 11-354319 | 12/1999 |
| JP | 2000-119826 | 4/2000 |
| JP | 2000-169947 | 6/2000 |
| JP | 2001-321847 | 11/2001 |
| JP | 2001-347355 | 12/2001 |
| JP | 2003-509221 | 3/2003 |
| JP | 2005-209592 | 8/2005 |
| JP | 2008-000783 | 1/2008 |
| JP | 2011-517623 | 6/2011 |
| JP | 2013-530045 | 7/2013 |
| KR | 10-0271356 | 11/2000 |
| WO | WO 01/21343 | 3/2001 |
| WO | WO 2009/048865 | 4/2009 |
| WO | WO 09/117735 | 9/2009 |
| WO | WO 11/127414 | 10/2011 |
| WO | WO 12/051443 | 4/2012 |
| WO | WO 12/092208 | 7/2012 |
| WO | WO 12/103552 | 8/2012 |
| WO | WO 12/112656 | 8/2012 |
| WO | WO 2014/078697 | 5/2014 |

OTHER PUBLICATIONS

Duan et al., "Bulk Metallic Glass with Benchmark Thermoplastic Processability", Adv. Mater., 2007, vol. 19, pp. 4272-4275.

Ehrt et al., "Electrical conductivity and viscosity of borosilicate glasses and melts," Phys. Chem. Glasses: Eur. J. Glass Sci. Technol. B, Jun. 2009, 50(3), pp. 165-171.

Love, "Temperature dependence of electrical conductivity and the probability density function," J. Phys. C: Solid State Phys., 16, 1983, pp. 5985-5993.

Mattern et al., "Structural behavior and glass transition of bulk metallic glasses," Journal of Non-Crystalline Solids, 345&346, 2004, pp. 758-761.

Wiest et al., "Zi-Ti-based Be-bearing glasses optimized for high thermal stability and thermoplastic formability", Acta Materialia, 2008, vol. 56, pp. 2625-2630.

Yavari et al., "Electromechanical shaping, assembly and engraving of bulk metallic glasses", Materials Science and Engineering A, 2004, vol. 375-377, pp. 227-234.

Yavari et al., "Shaping of Bulk Metallic Glasses by Simultaneous Application of Electrical Current and Low Stress", Mat. Res. Soc. Symp. Proc., 2001, vol. 644, pp. L12.20.1-L12.20.6.

Demetriou, Document cited and published during Applicant Interview Summary conducted on Jan. 29, 2013, entitled, "Rapid Discharge Heating & Forming of Metallic Glasses: Concepts, Principles, and Capabilities," Marios Demetriou, 20 pages.

(56) References Cited

OTHER PUBLICATIONS

Saotome et al., "Characteristic behavior of Pt-based metallic glass under rapid heating and it application to microforming," *Materials Science and Engineering A*, 2004, vol. 375-377, pp. 389-393.
Kulik et al., "Effect of flash-and furnace annealing on the magnetic and mechanical properties of metallic glasses," *Materials Science and Engineering, A133* (1991), pp. 232-235.
Johnson et al., "A Universal Criterion for Plastic Yielding of Metallic Glasses with a $(T/T_g)^{2/3}$ Temperature Dependence," *Physical Review Letter*, (2005), PRL 95, pp. 195501-195501-4.
Masuhr et al., Time Scales for Viscous Flow, Atomic Transport, and Crystallization in the Liquid and Supercooled Liquid States of Zr41.2Ti13.8Cu12.5Ni10.0Be22.5,: *Phys. Rev. Lett.*, vol. 82, (1999), pp. 2290-2293.
Schroers et al., "Pronounced asymmetry in the crystallization behavior during constant heating and cooling of a bulk metallic glass-forming liquid," *Phys. Rev. B*, vol. 60, No. 17 (1999), pp. 11855-11858.

* cited by examiner

RAPID DISCHARGE HEATING AND FORMING OF METALLIC GLASSES USING SEPARATE HEATING AND FORMING FEEDSTOCK CHAMBERS

The present application claims the benefit under 35 U.S.C. § 119(e) of U.S. Provisional Patent Application No. 62/013,671, entitled "Rapid Discharge Heating and Forming of Metallic Glasses Using Separate Heating and Forming Feedstock Chambers," filed on Jun. 18, 2014, which is incorporated herein by reference in its entirety.

FIELD OF THE DISCLOSURE

Methods and apparatuses for rapid discharge heating and forming metallic glass using separate chambers for feedstock heating and feedstock forming are provided.

BACKGROUND OF THE DISCLOSURE

The rapid discharge heating and forming (RDHF) method, as described in U.S. Patent Publication No. 2009/0236017, uses electrical current to heat a metallic glass charge substantially uniformly at time scales far shorter than typical times associated with crystallization, and shape the metallic glass into a metallic glass article. One example of a RDHF process is injection molding (as described in U.S. Patent Publication No. 2013/0025814, filed Jan. 31, 2013). Another example of a RDHF process is calendaring (as described in U.S. Pat. No. 8,613,815). In both methods, the metallic glass feedstock is rapidly and substantially uniformly heated by the electrical current flowing through it. In the injection molding method, the heated and softened feedstock is urged to flow into a mold. In the calendaring method, the heated and softened feedstock is urged to flow between a set of at least two rollers where it is shaped into a sheet. In both methods, the softened metallic glass is shaped and simultaneously cooled rapidly enough to form a metallic glass article.

In conventional RDHF methods, a feedstock barrel electrically insulates, mechanically supports, and confines the feedstock. Therefore, the feedstock barrel should exhibit low electrical conductivity and breakdown voltage together with high fracture toughness, thermal/chemical stability, and machinability/formability. Achieving electrical insulation together with mechanical performance is mutually exclusive in most typical engineering materials. For example, ceramics are very good electrical insulators but have poor mechanical performance, as they are generally brittle. On the other hand, metals are generally very tough, but they are poor electrical insulators as their electrical resistivities are generally very low.

BRIEF DESCRIPTION OF THE FIGURES

The description will be more fully understood with reference to the following figures and data graphs, which are presented as various embodiments of the disclosure and should not be construed as a complete recitation of the scope of the disclosure, wherein.

SUMMARY

Figure 1:
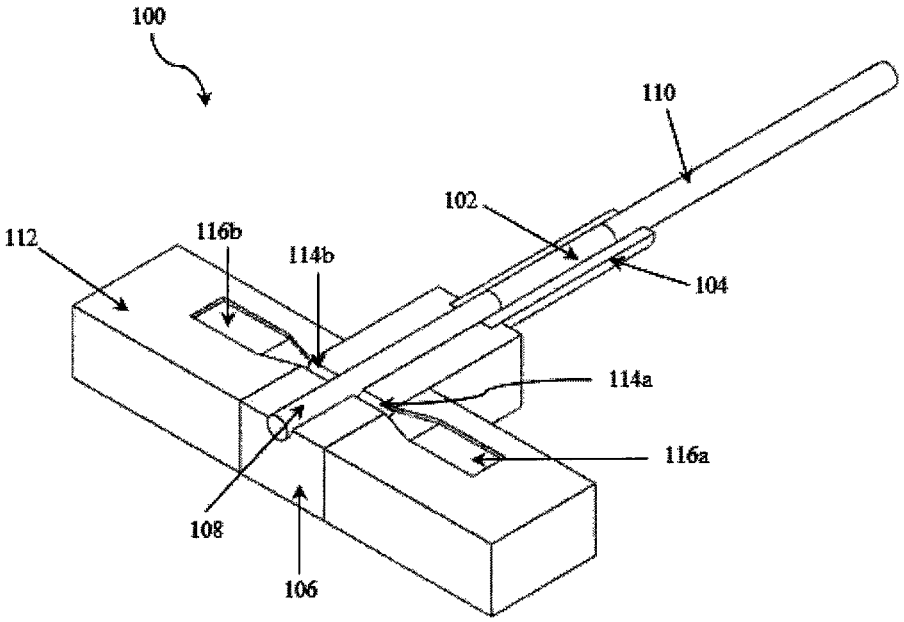
FIG. 1 provides a schematic drawing illustrating an example apparatus, where the apparatus components are indicated.

In various aspects, the disclosure is directed to a method of physically separating and electrically isolating the chamber in an RDHF method.

In one aspect, a method of forming a metallic glass is provided. A current is delivered to a metallic glass feedstock disposed in an electrically insulated heating barrel heat the feedstock to a heating temperature. The heated metallic glass feedstock is transferred to a forming barrel at a rate sufficiently rapid to maintain the heating temperature and inhibit feedstock crystallization. The heated feedstock is deformed inside the forming barrel such that the heated feedstock flows from the forming barrel to a shaping tool fluidly connected to the forming barrel.

In some embodiments, the shaping tool is a mold and the shaping processes is injection molding. In one embodiment, the mold comprises at least one transfer channel connected to at least one mold cavity such that the softened metallic glass can flow into the cavity and be shaped and simultaneously cooled rapidly enough to form a metallic glass article.

In other embodiments, the shaping tool is a set of rollers and the shaping process is calendaring. In one embodiment, the set of rollers comprise at least two rollers configured to apply a deformational force to shape the heated feedstock into a sheet.

In some embodiments, Ohmic heating of the metallic glass feedstock in the heating barrel can occur by discharging current through electrodes that contact the metallic glass feedstock at opposite ends. The electrodes are connected to an electrical energy source. In some embodiments, the electrical energy source comprises a capacitor, wherein the method of delivering a current to the metallic glass feedstock is capacitive discharge.

In some embodiments, a slight force is applied to the metallic glass feedstock inside the heating barrel sufficient to make electrical contact between the metallic glass feedstock and the electrodes while delivering the current to the metallic glass feedstock.

The transfer of the heated feedstock from the heating barrel to the forming barrel between the heating and the forming processes occurs at a rate sufficiently rapid to maintain the heating temperature (i.e. negligible cooling) and inhibit feedstock crystallization (i.e. produce substantially no crystallization) during the transfer. In some embodiments, transfer of the heated feedstock from the heating barrel to the forming barrel can occur through a transfer channel. In one embodiment, one or more electrodes disposed within the heating barrel can move along with the heated feedstock to the forming barrel to transfer the heated feedstock form the heating barrel to the forming barrel. In certain aspects, the heated feedstock can be transferred by using a pneumatic drive, hydraulic drive, magnetic drive, or an electric motor.

In various embodiments, the heating barrel can be made of a material that can exhibit a critical strain energy release rate of at least 0.1 $J/m^2$ and/or a fracture toughness of at least 0.05 MPa $m^{1/2}$. In various embodiments, the heating barrel material can exhibit an electrical resistivity at least $10^3$ times higher, or alternatively at least $10^4$ times higher, or alternatively at least $10^5$ times higher than the electrical resistivity of the bulk metallic glass. In various embodiments, the heating barrel material can exhibit a dielectric breakdown strength of at least 100 V/mm. In various embodiments, the heating barrel material can resist catastrophic ignition when exposed to a temperature of up to 800° C. for upto 0.5 s.

In certain aspects, the heating barrel may comprise a ceramic material as disclosed in U.S. Patent Publication No. 2013/0025814 (e.g. macor, yttria stabilized zirconia, fin-grained alumina), a cellulosic material (e.g. wood) as described or a plastic material (e.g. high density polyethylene) in U.S. Patent Publication No. 2015/0090375, which is incorporated herein by reference in its entirety. Alternatively, the heating barrel may comprise substrates coated with electrically insulating thin films (e.g. Kapton) as described in U.S. Patent Publication No. 2015/0096967, which is incorporated herein by reference in its entirety.

In some embodiments, flow of the heated feedstock from the forming barrel to the shaping tool can occur through a transfer channel. In one embodiment, flow of the heated feedstock from the forming barrel to the shaping tool can occur by moving one or more plungers disposed within the forming barrel to provide a force on the heated feedstock. In some embodiments, the plungers are connected to a mechanical drive, wherein the movement of one or more plungers occurs by using a mechanical drive. In one embodiment, the mechanical drive comprises a pneumatic drive, hydraulic drive, magnetic drive, or an electric motor. In some embodiments, the electrodes disposed within the heating barrel also act as plungers within the forming barrel.

In some embodiments, the forming barrel is electrically isolated from the components used for delivering the current to the metallic glass sample in the heating barrel.

In some embodiments, the forming barrel can comprise a metal.

In certain aspects, the forming barrel can comprise a metal selected from the group consisting of low-carbon steels, stainless steels, tool steels, nickel alloys, titanium alloys, aluminum alloys, copper alloys, brasses and bronzes, and pure metals such as nickel, aluminum, copper, and titanium.

In other aspects, transfer of the heated feedstock from the heating barrel to the forming barrel occurs over a time not to exceed 1 s, or in other embodiments not to exceed 100 ms, or in yet other embodiments not to exceed 10 ms, or in yet other embodiments not to exceed 1 ms.

DETAILED DESCRIPTION OF THE DISCLOSURE

The RDHF process involves rapidly pulsing electrical current through a metallic glass feedstock via electrodes in contact with feedstock in order to rapidly heat the feedstock to a temperature conducive to viscous flow. Once the feedstock reaches the viscous state, deformational force is applied to the heated feedstock causing it to deform. The steps of heating and deformation are performed over a time scale shorter than the time required to crystallize the heated feedstock. Subsequently, the deformed feedstock is allowed to cool to below the glass transition temperature, such as by contacting it with a thermally conductive metal mold or die, in order to vitrify it into an amorphous article.

In the injection molding mode of RDHF, a feedstock barrel houses the feedstock and electrically insulates it during electrical discharge from the surrounding metal tooling. A feedstock barrel is also needed to mechanically confine the feedstock once it reaches its viscous state and the deformational force is applied, and to guide the deforming feedstock through an opening in the chamber and onto a runner that leads to a mold cavity which the softened feedstock would ultimately fill.

A single heating and forming compartment, referred to as the "feedstock barrel", (1) insulates the electrodes in contact with the feedstock from the surrounding tooling, and (2) mechanically confines the heated and softened feedstock as it is being deformed by the electrodes/plungers and urged through the runner towards the mold cavity. The two functions of the feedstock barrel are mutually exclusive. This is because materials that are electrically insulating (e.g. ceramics) tend to also be brittle; on the other hand, materials that are tough (e.g. metals) are usually not electrically insulating. Solutions are focused on materials that are electrically insulating and adequately tough. U.S. Patent Publication No. 2015/0090375 describes cellulosic barrels and polymeric materials. Also, since they are relatively inexpensive, such materials can be used for single-use disposable barrels without substantially adding to the overall tooling cost per cycle. In yet another aspect, barrels coated with an insulating film have been described in U.S. Patent Publication No. 2015/0096967. In this aspect, the toughness of metals is utilized in conjunction with the electrical insulation of the film to provide the combination of toughness and electrical insulation.

The presently disclosed method physically separates and electrically isolates the heating barrel (where the ohmic heating of the feedstock occurs) from the forming barrel, where the feedstock deformation takes place. In this manner, the heating barrel has electrically insulating properties but is not subject to the substantial mechanical load. In some embodiments, a slight force may be applied to the feedstock inside the heating barrel sufficient to make electrical contact between the feedstock and the electrodes until current is delivered.

The forming barrel is subject to a mechanical load, but need not electrically insulate the heated feedstock. Consequently, since the heating barrel will not be subject to high mechanical loading, it can withstand multiple RDHF cycles without failure. In some embodiments, the forming barrel can be electrically isolated from the components of the electrical circuit (such as the electrodes) during the current discharge process such that current flow across the forming barrel is prevented. The current discharge through the feedstock occurs predominantly in the heating barrel. Since electrical current does not flow across the forming barrel, a strong and tough material can be used in spite of the fact that it would likely be a poor electrical insulator.

In some embodiments, the heating barrel may comprise a material that can exhibit a critical strain energy release rate of at least 0.1 $J/m^2$ and a fracture toughness of at least 0.05 MPa $m^{1/2}$. In various embodiments, the heating barrel material can exhibit an electrical resistivity at least $10^3$ times higher than the electrical resistivity of the bulk metallic glass feedstock. In various embodiments, the heating barrel material can exhibit a dielectric breakdown strength of at least 100 V/mm. In various embodiments, the heating barrel material can resist catastrophic ignition when exposed to a temperature of up to 800° C. for up to 0.5 s. In some embodiments, the heating barrel may comprise a ceramic material, such as for example macor, yttria stabilized zirconia, or fine-grained alumina, a cellulosic material, such as natural wood, paper and paper laminates, or fiberboard, or a synthetic polymeric material like high density polyethylene, polypropylene, or G-10 Glass/Phenolic Laminate.

In some embodiments, the forming barrel may comprise a metal selected from the group consisting of low-carbon steels, stainless steels, tool steels, nickel alloys, titanium alloys, aluminum alloys, copper alloys, brasses and bronzes, and pure metals such as nickel, aluminum, copper, and titanium.

In some embodiments, the forming barrel, which may be electrically conducting, may be electrically isolated from the components used in the step of delivering the current to the metallic glass sample (i.e. components in the heating barrel such as the electrical discharge circuit) during the current discharge process such that electrical current flow from such components to the forming barrel is avoided. In certain embodiments, this can be achieved by placing the forming barrel on the side of the ground electrode such that it encases the ground electrode during current discharge. In other embodiments, this can be achieved by coating the interior of the forming barrel with an electrically insulating film. In certain embodiments, the film can have an electrical resistivity and dielectric strength such that it would prevent electrical discharge between the barrel and a component of the electrical circuit, such as an electrode, during the current discharge process. In certain embodiments, the film can have an electrical resistivity of at least $1\times10^5$ μΩ-cm, and a dielectric strength of at least 1000 V/mm.

The method also includes transferring the feedstock from the heating barrel to the forming barrel between the heating and the forming processes at a rate sufficiently rapid to maintain the heating temperature and inhibit feedstock crystallization. Specifically, after the current discharge process is substantially completed in the heating barrel, the heated feedstock is transferred to the forming barrel at a rate high enough such that negligible cooling and no substantial crystallization of the feedstock take place during the transfer. In certain embodiments, the heated feedstock may be transferred by a pneumatic drive, hydraulic drive, magnetic drive, or an electric motor.

In various aspects, inhibiting feedstock crystallization refers to a volume fraction of crystallinity in the heated feedstock, such as during transfer from the heating barrel to the forming barrel that does not exceed 5%. Alternatively the volume fraction of crystallinity in the heated feedstock does not exceed 1%. Alternatively the volume fraction of crystallinity in the heated feedstock does not exceed 0.5%. Alternatively the volume fraction of crystallinity in the heated feedstock does not to exceed 0.1%.

In various aspects, maintaining the heating temperature, such as during transfer from the heating barrel to the forming barrel, refers to not varying the temperature of the heated feedstock by more than 50° C. during transfer. Alternatively, the heated feedstock may not vary by more than 10° C. during transfer. Alternatively, the heated feedstock may not vary by more than 5° C. during transfer. Alternatively, the heated feedstock may not vary by more than 1° C. during transfer.

Example Apparatus

An example metallic glass forming apparatus 100 is illustrated schematically in FIG. 1. The various elements of the apparatus 100, include the metallic glass feedstock 102, a split heating barrel 104 (only one half of the split barrel 104 is illustrated), a split forming barrel 106 (only one half of the split barrel 106 is illustrated), the bottom electrode 108 which also acts as ground, the top electrode 110 which also acts as plunger, and a split mold 112 that includes transfer channels 114*a* and 114*b* and mold cavities 116*a* and 116*b* (only one half of the split mold 112 is illustrated) are indicated in FIG. 1. In this configuration, the forming barrel 106, which may be electrically conducting, is placed on the side of the bottom electrode 108 such that it encases the ground electrode 108 during current discharge. As such, it is effectively electrically isolated from the components of the electrical discharge circuit during the current discharge process such that electrical discharge between such components and the forming barrel 108 would be avoided.

Figure 2:
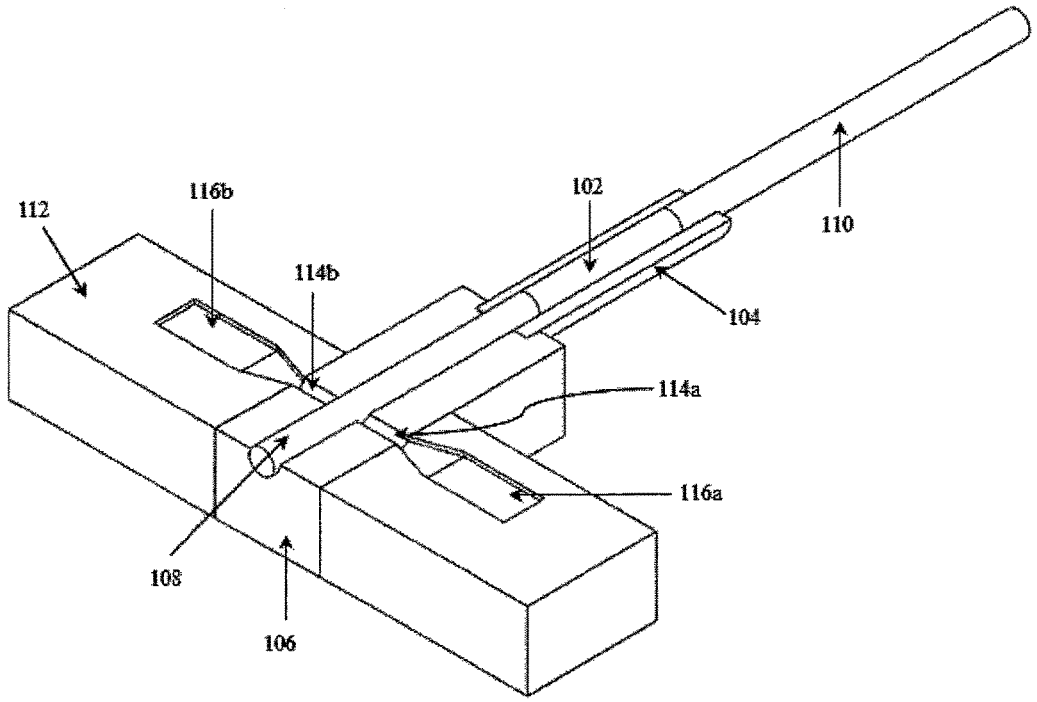
FIG. 2 provides a schematic drawing illustrating the heating of the feedstock in the heating barrel by current discharge across the feedstock through the electrodes.

The operation of the apparatus is illustrated in FIGS. 2-5. In FIG. 2, current flow heats the feedstock 102 in the heating barrel 104 by current discharge across the feedstock 102 through electrodes 108 and 110.

Figure 3:
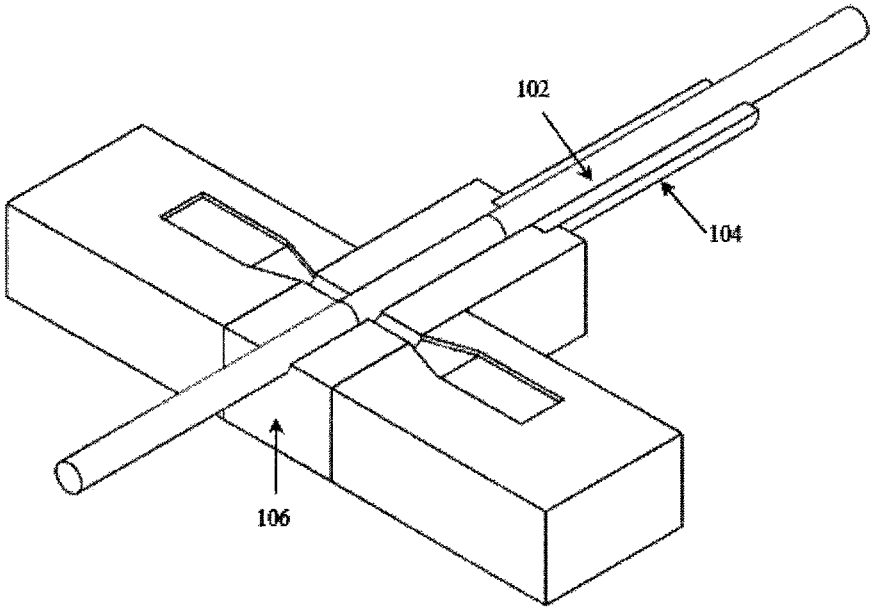
FIG. 3 provides a schematic drawing illustrating the transfer of the feedstock from the heating barrel to the forming barrel.

In FIG. 3, transfer of the feedstock 102 from the heating barrel 104 to the forming barrel 106 is illustrated, where the feedstock 102 that has been heated along with the electrodes 108 and 110 are simultaneously transferred to the forming barrel 106.

Figure 4:
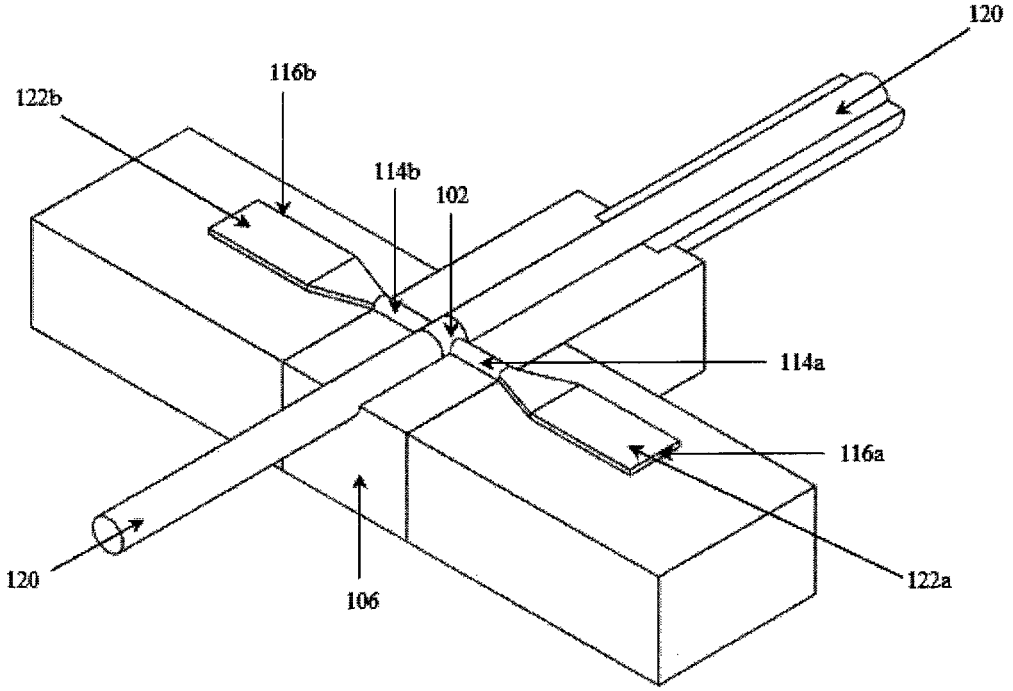
FIG. 4 provides a schematic drawing illustrating the forming of the heated feedstock in the forming barrel such that the heated feedstock flows into the mold.

FIG. 4 illustrates forming of the feedstock 102 in the forming barrel 106. The top electrode 110 moves against the bottom electrode 108 by the application of force 120 to transfer the heated (and softened) feedstock 102 out of the forming barrel 106 through the transfer channels 114*a* and 114*b* and into the mold cavities 116*a* and 116*b* to form a metallic glass article 122*a* and 122*b*.

Figure 5:
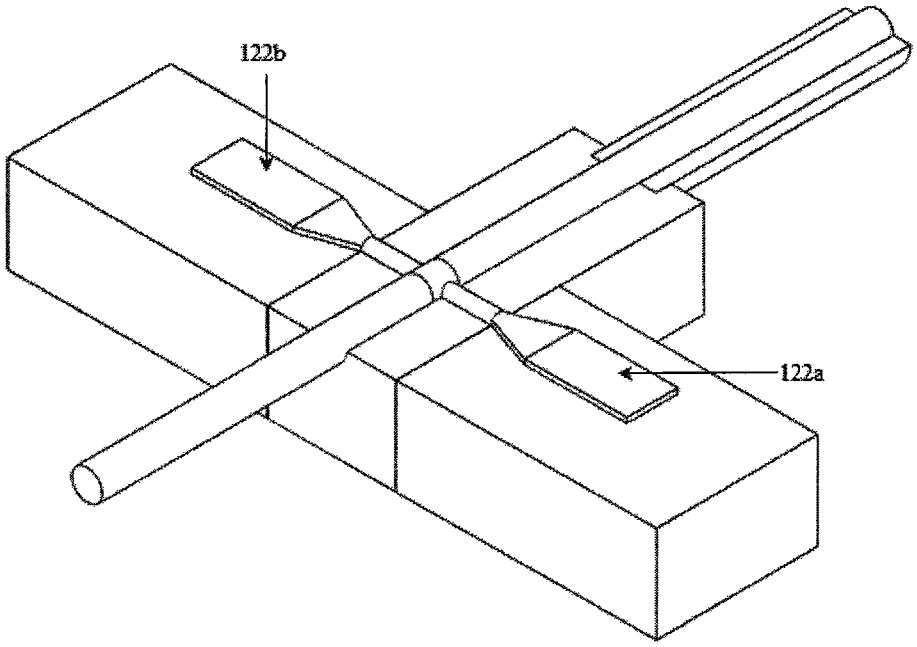
FIG. 5 provides a schematic drawing illustrating cooling the feedstock in the mold to form a metallic glass article.

In FIG. 5, cooling of the metallic glass article 122*a* and 122*b* in the mold is illustrated.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A method of forming a metallic glass comprising:

delivering a current to a metallic glass feedstock disposed in an electrically insulated heating barrel to heat the metallic glass feedstock to a heating temperature to form a heated metallic glass feedstock;

transferring the heated metallic glass feedstock from the heating barrel to a forming barrel at a rate sufficiently rapid to maintain the heating temperature and inhibit feedstock crystallization, wherein the forming barrel is physically separated from the heating barrel;

applying a mechanical force to deform the heated metallic glass feedstock inside the forming barrel such that the heated metallic glass feedstock flows from the forming barrel to a mold fluidly connected to the forming barrel.

2. The method of claim 1, wherein the step of delivering a current to the metallic glass feedstock comprises forming an electrical connection between the feedstock and two electrodes disposed on opposing sides of the feedstock within the heating barrel, wherein the two electrodes are connected to an electrical source.

3. The method of claim 2, wherein the step of delivering a current to a metallic glass feedstock comprises applying a slight force to the metallic glass feedstock inside the heating barrel to make electrical contact between the feedstock and the two electrodes.

4. The method of claim 1, wherein the step of transferring the heated metallic glass feedstock from the heating barrel to the forming barrel is through a transfer channel connecting the heating barrel and the forming barrel.

5. The method of claim 1, wherein the step of transferring the heated metallic glass feedstock from the heating barrel to the forming barrel comprises moving one or more electrodes disposed within the heating barrel such that the heated metallic glass feedstock is transferred from the heating barrel to the forming barrel.

6. The method of claim 1, wherein the flow of the heated metallic glass feedstock from the forming barrel to the mold occurs through a transfer channel.

7. The method of claim 1, wherein the flow of the heated metallic glass feedstock from the forming barrel to the mold occurs by moving one or more plungers disposed within the forming barrel to provide a force on the heated metallic glass feedstock.

8. The method of claim 1, wherein the step of transferring the heated metallic glass feedstock to the forming barrel comprises using a pneumatic drive, hydraulic drive, magnetic drive, or an electric motor.

9. The method of claim 1, wherein the step of transferring the heated metallic glass feedstock from the heating barrel to the forming barrel occurs over a time period that does not exceed 1 s.

10. A method of forming a metallic glass comprising:

delivering a current to a metallic glass feedstock disposed in an electrically insulated heating barrel to heat the metallic glass feedstock to a heating temperature to form a heated metallic glass feedstock;

transferring the heated metallic glass feedstock from the heating barrel to a forming barrel at a rate sufficiently rapid to maintain the heating temperature and inhibit feedstock crystallization, wherein the forming barrel is physically separated from the heating barrel;

applying a mechanical force to deform the heated metallic glass feedstock inside the forming barrel such that the heated metallic glass feedstock flows from the forming barrel to a set of rollers fluidly connected to the forming barrel.

11. The method of claim 10, wherein the step of delivering a current to the metallic glass feedstock comprises forming an electrical connection between the feedstock and two electrodes disposed on opposing sides of the feedstock within the heating barrel, wherein the two electrodes are connected to an electrical source.

12. The method of claim 11, wherein the step of delivering a current to a metallic glass feedstock comprises applying a slight force to the metallic glass feedstock inside the heating barrel to make electrical contact between the feedstock and the two electrodes.

13. The method of claim 10, wherein the step of transferring the heated metallic glass feedstock from the heating barrel to the forming barrel is through a transfer channel connecting the heating barrel and the forming barrel.

14. The method of claim 10, wherein the step of transferring the heated metallic glass feedstock from the heating barrel to the forming barrel comprises moving one or more electrodes disposed within the heating barrel such that the heated metallic glass feedstock is transferred from the heating barrel to the forming barrel.

15. The method of claim 10, wherein the flow of the heated metallic glass feedstock from the forming barrel to the set of rollers occurs through a transfer channel.

16. The method of claim 10, wherein the flow of the heated metallic glass feedstock from the forming barrel to the set of rollers occurs by moving one or more plungers disposed within the forming barrel to provide a force on the heated metallic glass feedstock.

17. The method of claim 10, wherein the step of transferring the heated metallic glass feedstock to the forming barrel comprises using a pneumatic drive, hydraulic drive, magnetic drive, or an electric motor.

18. The method of claim 10, wherein the step of transferring the heated metallic glass feedstock from the heating barrel to the forming barrel occurs over a time period that does not exceed 1 s.

* * * * *